US007150425B2

(12) United States Patent
Banaszkiewicz et al.

(10) Patent No.: US 7,150,425 B2
(45) Date of Patent: Dec. 19, 2006

(54) ADJUSTABLE REEL ASSEMBLY

(75) Inventors: Gregory G. Banaszkiewicz, Fort Wayne, IN (US); Edward L. Walter, Columbia City, IN (US); Sanford R. Penn, Fort Wayne, IN (US)

(73) Assignee: Reelcraft Industries, Inc., Columbia City, ID (US)

( * ) Notice: Subject to any disclaimer, the term of this patent is extended or adjusted under 35 U.S.C. 154(b) by 119 days.

(21) Appl. No.: 10/446,592

(22) Filed: May 28, 2003

(65) Prior Publication Data

US 2004/0238675 A1 Dec. 2, 2004

(51) Int. Cl.
*B65H 75/48* (2006.01)

(52) U.S. Cl. ..... 242/385.3; 242/377; 242/397.2; 137/355.26

(58) Field of Classification Search ..... 242/377, 242/397.2, 346.4, 385.2, 385.3; 137/355.26, 137/355.27
See application file for complete search history.

(56) References Cited

U.S. PATENT DOCUMENTS

| | | | | | |
|---|---|---|---|---|---|
| 671,225 | A | * | 4/1901 | Nycum | 242/396.4 |
| 673,907 | A | * | 5/1901 | Johnson | 242/399.2 |
| 745,670 | A | | 12/1903 | Riley | |
| 1,908,852 | A | * | 5/1933 | Lea | 242/385.1 |
| 2,608,605 | A | * | 8/1952 | Barend | 324/658 |
| 2,907,534 | A | | 10/1959 | Benstein | 242/86 |
| 3,176,931 | A | | 4/1965 | Hannay | 242/107.7 |
| 3,625,450 | A | | 12/1971 | Lloyd, Jr. | 242/86 |
| 3,694,588 | A | | 9/1972 | Appleton | 191/12.2 |
| 3,822,719 | A | * | 7/1974 | Nederman | 137/355.26 |
| 4,154,324 | A | | 5/1979 | Upton et al. | 191/12.2 R |
| 4,224,960 | A | | 9/1980 | Nederman | 137/355.23 |
| 4,543,982 | A | * | 10/1985 | Wolfe | 137/355.21 |
| 4,635,874 | A | * | 1/1987 | Swindlehurst | 242/383.1 |
| 4,813,627 | A | * | 3/1989 | Nelson | 242/373 |
| 5,101,082 | A | * | 3/1992 | Simmons et al. | 191/12.2 R |
| 5,381,820 | A | * | 1/1995 | Chandler | 137/355.23 |
| 5,495,995 | A | | 3/1996 | Dominique et al. | 242/390.1 |
| 5,787,923 | A | | 8/1998 | Shea et al. | 137/355.26 |
| D476,879 | S | * | 7/2003 | Chu | D8/358 |

* cited by examiner

*Primary Examiner*—William A. Rivera
*Assistant Examiner*—Sang Kim
(74) *Attorney, Agent, or Firm*—Baker & Daniels LLP

(57) ABSTRACT

A reel assembly for storing a hose, an electrical cord, or other items. The reel assembly includes a base, a spool rotatably mounted to the base, and a guide arm adjustably mounted to the base for guiding the direction in which a hose, for example, is extended from the reel and for guiding the hose onto the reel as the hose is wound upon the reel. A spring is operably connected between the spool and the base to bias the spool in a rotational direction in which the hose is wound onto the spool, thereby automatically retracting the hose after use. A pawl mechanism is mounted to the guide arm, and cooperates with a pair of ratchet teeth sets on the spool to selectively lock the spool against rotation in a hose-winding direction, thereby maintaining the hose in a desired extended position for use. The relative orientation of the ratchet teeth sets and the pawl mechanism, which is mounted to the guide arm, prevents "latch-out" when the hose is disposed in its fully extended position. Also, the spring is permanently enclosed within a spring housing defined between the spool and a cover which is permanently attached to the spool.

29 Claims, 6 Drawing Sheets

ADJUSTABLE REEL ASSEMBLY

BACKGROUND OF THE INVENTION

1. Field of the Invention

The present invention relates to reels for storing hoses, electrical cords, ropes, cables, or other items. In particular, the present invention relates to a reel which includes a spring-driven spool for automatically retracting and winding a hose, for example, thereon.

2. Description of the Related Art

Reel assemblies are used to store items such as hoses of the type which are used to deliver water or air, for example, or which may also be used to deliver hydraulic fluid or grease. Alternatively, such reel assemblies may be used to store electrical cords, ropes, cables, or other items.

Known hose reels generally include a base, a spool rotatably mounted on the base and having a hose wound thereon, and a guide arm attached to the base for supporting and/or guiding the hose as the hose is extended from the spool or is wound upon the spool. In some hose reels, the guide arm is adjustably connected to the base to facilitate mounting the hose reel in varying orientations and/or to vary the direction in which the hose is extended from or wound upon the hose reel, as guided by the guide arm. The base and spool also include suitable fittings for connecting a source of fluid to the hose reel, and in turn for connecting an end of the hose to the hose reel in fluid communication with the fluid source.

Further, known hose reels also include a spring-retracting feature such that, as the hose is unwound from the spool, a spring in the spool or base is placed under tension, and when the pull force on the hose is released, the spring rotates the spool in a direction in which the hose is wound upon the spool. A pawl, mounted to the base of the hose reel, selectively engages ratchet teeth associated with the spool to lock the spool against rotation in the hose-winding direction, such that the hose may be retained in a desired extended position. When the hose is further extended from its retained position, the pawl is released from the ratchet teeth to allow the spring to rotate the spool and retract the hose.

Such hose reels may also include a tension relief member, such as a U-bolt, which is attached to the spool for capturing the hose against the spool, thereby preventing tension from being imposed directly on the connection between the end of the hose and the fluid input structure. In known hose reels, the position of the U-bolt on the spool must be adjusted whenever the position of the guide arm is adjusted, which necessitates partial disassembly of the hose reel and unwinding the hose from the spool. If the position of the U-bolt is not so adjusted, the pawl may be disposed in engagement with the ratchet teeth upon maximum extension of the hose, such that the user cannot pull the hose outwardly a further distance in order to disengage the pawl from the ratchet teeth. In this condition, known as "latch-out", the hose is not retractable, but rather is jammed in its fully extended position. Release of the hose in a "latch-out" event requires manual disengagement of the pawl.

In addition, in known hose reels, the spring is contained within a spring housing and is coiled under tension. The spring housing includes a cover which is removeable with tools. This arrangement allows for the possibility of unauthorized removal of the cover from the spring housing to thereby potentially expose the spring, which is undesirable when the spring is under tension.

SUMMARY OF THE INVENTION

The present invention provides a reel assembly for storing a hose, for example, the reel including a base, a spool rotatably mounted to the base, and a guide arm adjustably mounted to the base for guiding the direction in which the hose is extended from the hose reel as the hose is pulled outwardly therefrom, and for guiding the hose onto the reel as the hose is wound upon the reel. A spring is operably connected between the spool and the base to bias the spool in a rotational direction in which the hose is wound onto the spool, thereby automatically retracting the hose after use. A pawl mechanism is mounted to the guide arm, and cooperates with a pair of ratchet teeth sets on the spool to selectively lock the spool against rotation in a hose-winding direction, thereby maintaining the hose in a desired extended position for use.

Advantageously, in one aspect of the present invention, the relative orientation of the ratchet teeth sets and the pawl mechanism, which is mounted to the guide arm, positions the pawl mechanism between adjacent sets of ratchet teeth when the hose is in its fully extended position, thereby allowing the hose to be retracted regardless of the position of the guide arm with respect to the base. Thus, the foregoing structure prevents "latch-out" when the hose is disposed in its fully extended position.

In another aspect of the present invention, the spring is permanently enclosed within a spring housing which is defined between the spool and a cover permanently attached to the spool. The foregoing spring housing is not openable with tools, and thereby prevents unauthorized opening of the spring housing and possible exposure of the spring.

In one form thereof, the present invention provides a reel assembly, including a base; a spool rotatably mounted to the base, the spool including at least one set of ratchet teeth; a guide arm connected to the base and extending therefrom; and a pawl member mounted to the guide arm, the pawl member engagable with the ratchet teeth.

In another form thereof, the present invention provides a hose reel, including a base; a spool rotatably mounted to the base, the spool including at least one set of ratchet teeth; a guide arm mounted to the base and extending therefrom; a pawl member mounted to the guide arm, the pawl member engagable with the ratchet teeth; and a hose having a first end connected to one of the spool and the base and a second end, the hose moveable between a fully retracted position wherein the hose is substantially wound about the spool and a fully extended position wherein the hose is extended from the spool and the pawl member is not in engagement with the ratchet teeth.

In a further form thereof, the present invention provides a hose reel, including a base; a spool rotatably mounted to the base, the spool having opposite first and second sides; a hose having a first end connected to one of the spool and the base, the hose windable about the spool; a cover permanently attached to one of the sides of the spool, the spool and the cover together defining a substantially enclosed spring housing therebetween; and a spring carried within the spring housing.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
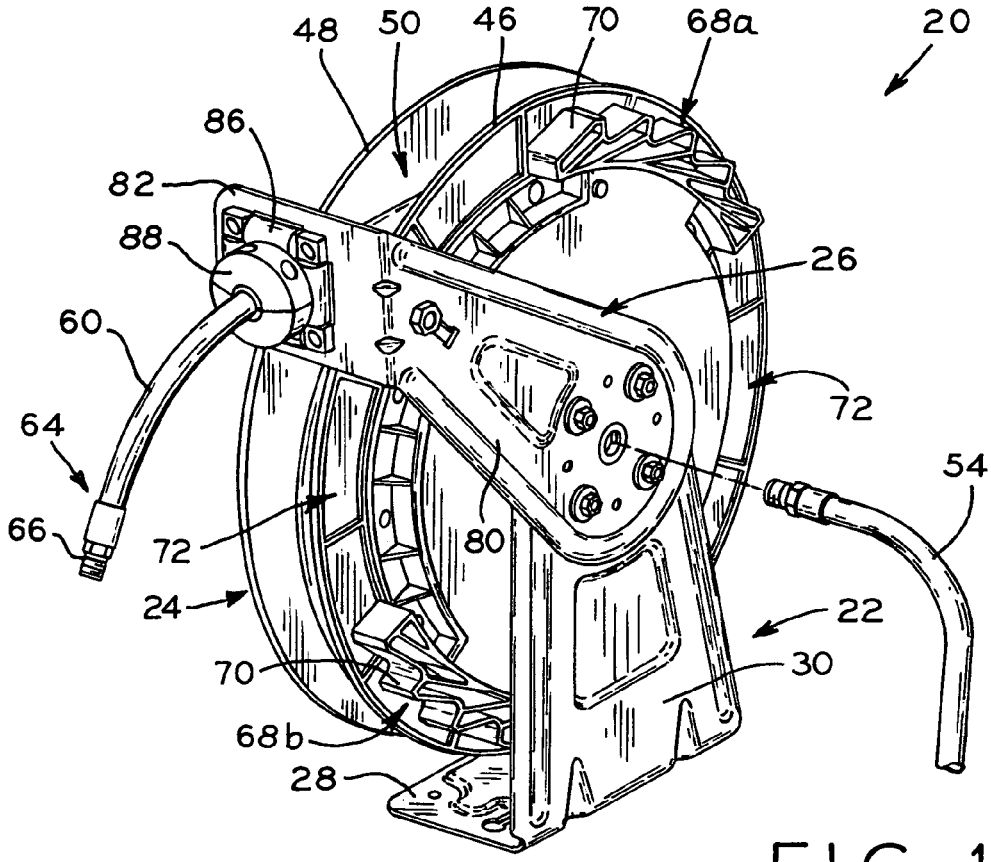
FIG. 1 is a front perspective view of a reel assembly in accordance with the present invention, showing the attachment of a fluid input line to the reel assembly.
Figure 2:
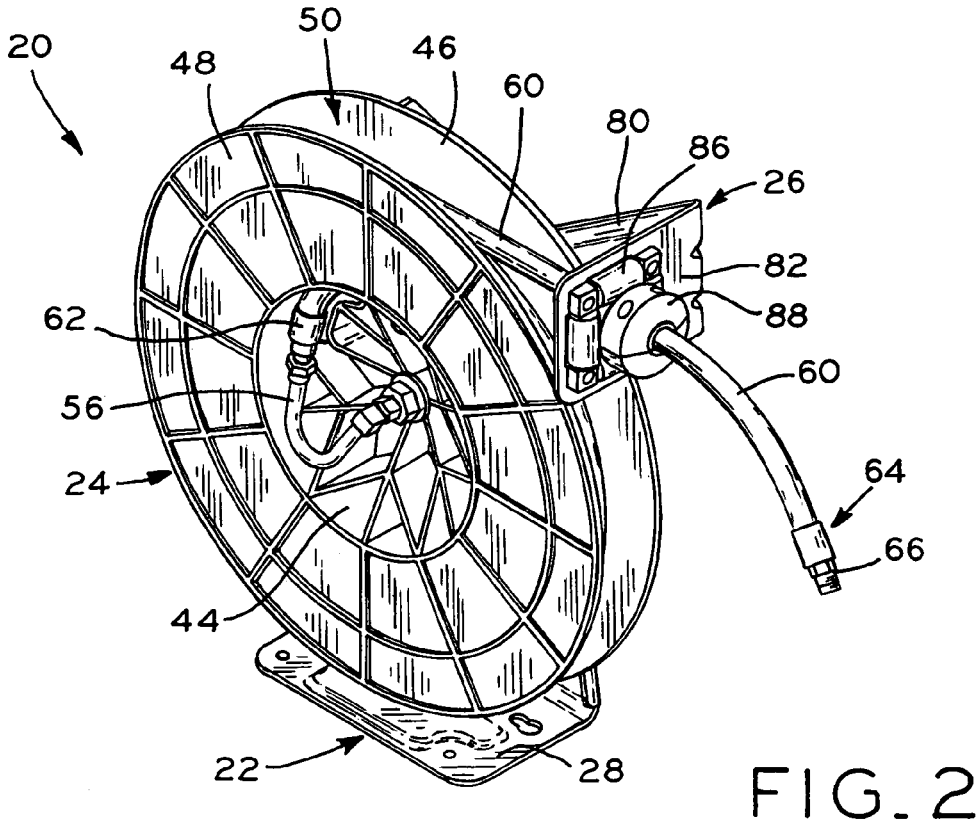
FIG. 2 is a rear perspective view of the reel assembly of FIG. 1.
Figure 3:
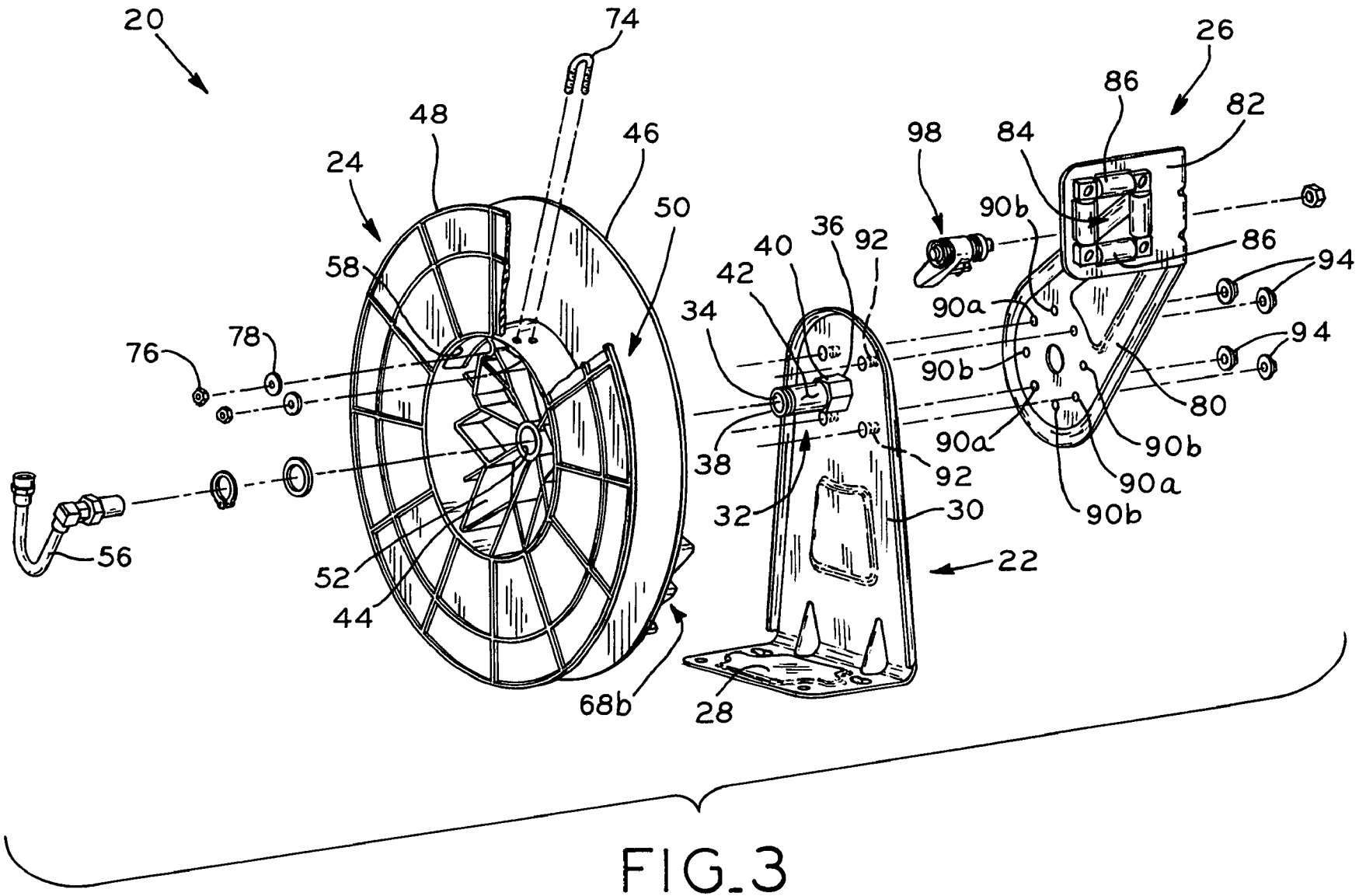
FIG. 3 is an exploded view of the reel assembly of FIGS. 1 and 2.

Referring first to FIGS. 1–3, a reel assembly in accordance with the present invention is shown in the form of hose reel 20. Hose reel 20 is described below with reference to a hose, which is stored on hose reel 20 and which is extendable from and retractable onto hose reel 20. However, it should be understood that the reel assembly of the present invention may also be used with other elongate members such as electrical cords, ropes, cables, or other items.

Hose reel 20 generally includes base 22 upon which spool 24 is rotatably mounted, and guide arm 26 adjustably connected to base 22. Base 22 includes base plate 28, which is mountable to a mounting surface as discussed below. Support plate 30 extends from base plate 28, and axle 32 is affixed to support plate 30 in a suitable manner. Axle 32 includes bore 34 (FIG. 3) therethrough, which extends between first end 36 and second end 38 of axle 32. Axle 32 further includes hex portion 40 disposed adjacent support plate 30, and bearing surface 42.

Spool 24 includes central hub 44 with first and second sides 46 and 48 extending therefrom to define hose channel 50 therebetween. Central hub 44 of spool 24 includes bore 52 (FIG. 3), through which axle 32 of base 22 is inserted to rotatably mount spool 24 on base 22, such that central hub 44 of spool 24 is rotatable on bearing surface 42 of axle 32.

Referring to FIG. 1, fluid inlet line 54 is threadably connected to first end 36 of axle 32, optionally using suitable gaskets and/or washers. Referring to FIGS. 2 and 3, after spool 24 is mounted on axle 32, fluid joint 56 is threadably attached to second end 38 of axle 32 with suitable gaskets and/or washers to thereby capture spool 24 for rotation on axle 32 between hex portion 40 of axle 32 and fluid joint 56. Hose 60 includes first end 62 (FIG. 2), which is inserted through aperture 58 (FIG. 3) in central hub 44 of spool 24 and is threadably attached to fluid joint 56. Second end 64 of hose 60 includes fitting 66 to which a spray nozzle (not shown) may be attached, for example. A fluid, such as water or air, enters through fluid inlet line 54 into bore 34 of axle 32, and then passes through bore 34, fluid joint 56, and hose 60 for delivery. The type of fluid joint 56 used, and the manner in which same is attached to second end 38 of axle, may be configured for low pressure applications, such as water or air, or alternatively, may be configured for medium or high pressure applications, such as hydraulic fluid or grease, for example. Still further, if the present reel assembly us used with an electrical cord, for example, suitable electrical input connections may be provided.

Referring to FIG. 1, spool 24 additionally includes two sets 68*a* and 68*b* of ratchet teeth 70, which are integrally formed with spool 24 and are disposed on first side 46 of spool 24 along a portion of the outer periphery of spool 24. Spool 24 and ratchet teeth 70 may be integrally formed of a rigid plastic, for example. Alternatively, ratchet teeth 70 may comprise separate components mounted to spool 24, or may be formed as a part of a separate component which is attached to spool 24 and rotatable upon axle 32, for example. In this manner, spool 24 may alternatively be formed of metal, such as steel, with ratchet teeth formed of a rigid plastic or metal. Sets 68*a* and 68*b* of ratchet teeth 70 are spaced opposite one another in a 180° opposed manner to define angular gaps 72 therebetween. Additionally, as shown in FIG. 3, spool 24 includes U-bolt 74 attached to central hub 44 of spool 24 by nuts 76 and washers 78. As explained below, U-bolt 74 captures a portion of hose 60 between U-bolt 74 and spool 24 to relieve strain upon the connection of first end 62 of hose 60 with fluid joint 56 when hose 60 is in its fully extended position.

Referring to FIG. 3, guide arm 26 includes arm portion 80 terminating in guide section 82. Guide section 82 includes opening 84 with a plurality of rollers 86 mounted therearound to guidably support hose 60 as hose 60 is extended from, or is retracted and wound upon, spool 24. Second end 62 of hose 60 may include hose bumper 88 mounted thereto in a known manner such that hose bumper 88 abuts guide section 82 of guide arm 26 to limit the retraction of hose 60.

Figure 4:
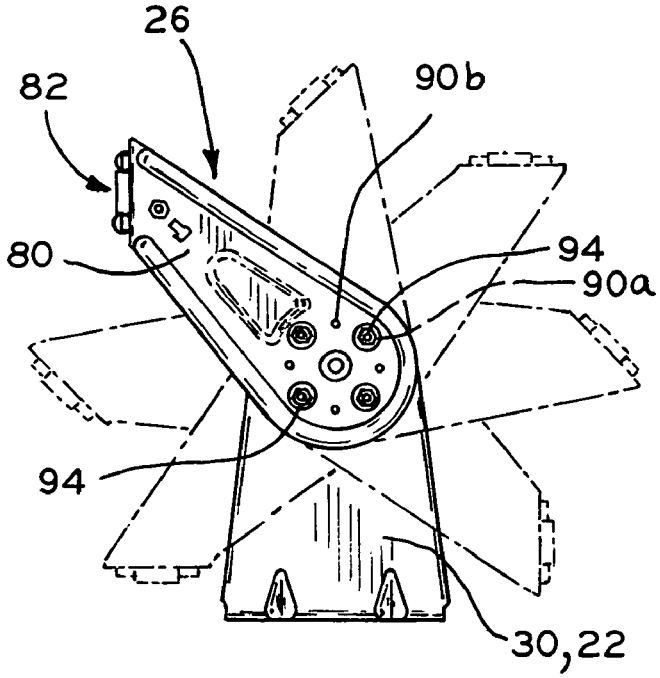
FIG. 4 is a side elevational view which schematically shows the adjustable connection of the guide arm to the base in one of a plurality of radially spaced positions.

Guide arm 26 includes a plurality of apertures 90 spaced in a circular orientation, including a first set of four apertures 90*a* and a second set of four apertures 90*b*. One of sets 90*a* and 90*b* of apertures 90 are inserted upon four corresponding bolts 92 extending from support plate 30 of base 22, and nuts 94 are thereafter screwed upon bolts 92 to attach guide arm 26 to base 22. As shown in FIG. 4, guide arm 26 is adjustably mounted to base 22 in one of a plurality of radially spaced positions with respect to base 22 by varying the orientation of guide arm 26 with respect to base 22, as well as by selecting which set of apertures 90*a* and 90*b* of guide arm 26 are used to connect guide arm 26 to base 22.

Figure 5:
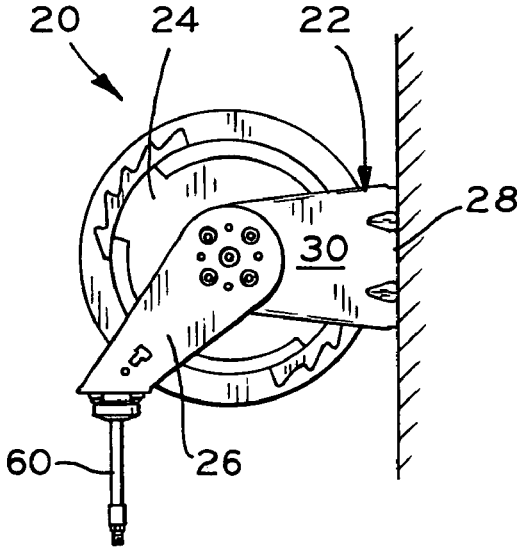
FIG. 5 is an elevational view of the reel assembly in a wall mount application.
Figure 6:
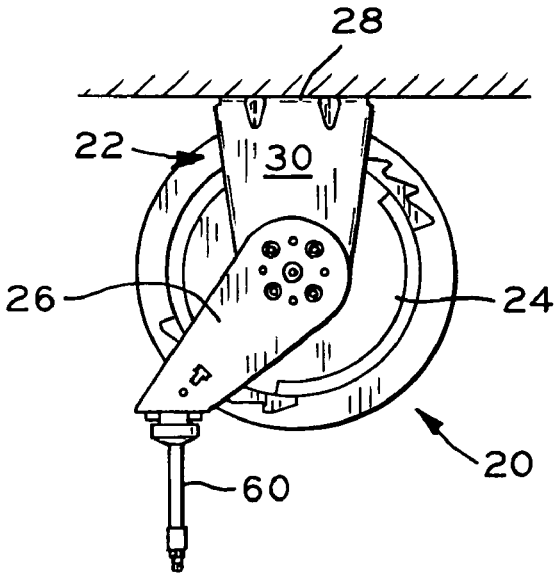
FIG. 6 is an elevational view of the reel assembly in a ceiling mount application.

The foregoing adjustable connection between guide arm 26 and base 22 allows hose reel 20 to be mounted in one of several orientations, in order to suit the needs of a particular application. For example, in FIGS. 1 and 2, base plate 28 of base 22 may be secured to a horizontal surface, such as a floor or a workbench, for example. As shown in FIG. 5, base plate 28 of base 22 may be mounted to a vertical surface, such as an interior or exterior building wall. Still further, as shown in FIG. 6, base plate 28 of base 22 may be mounted to a ceiling. In each of the foregoing applications, the position of guide arm 26 with respect to base 22 may be adjusted such that guide arm 26 supportably guides hose 60 in a desired direction as hose 60 is extended from, or wound onto, spool 24.

Figure 7:
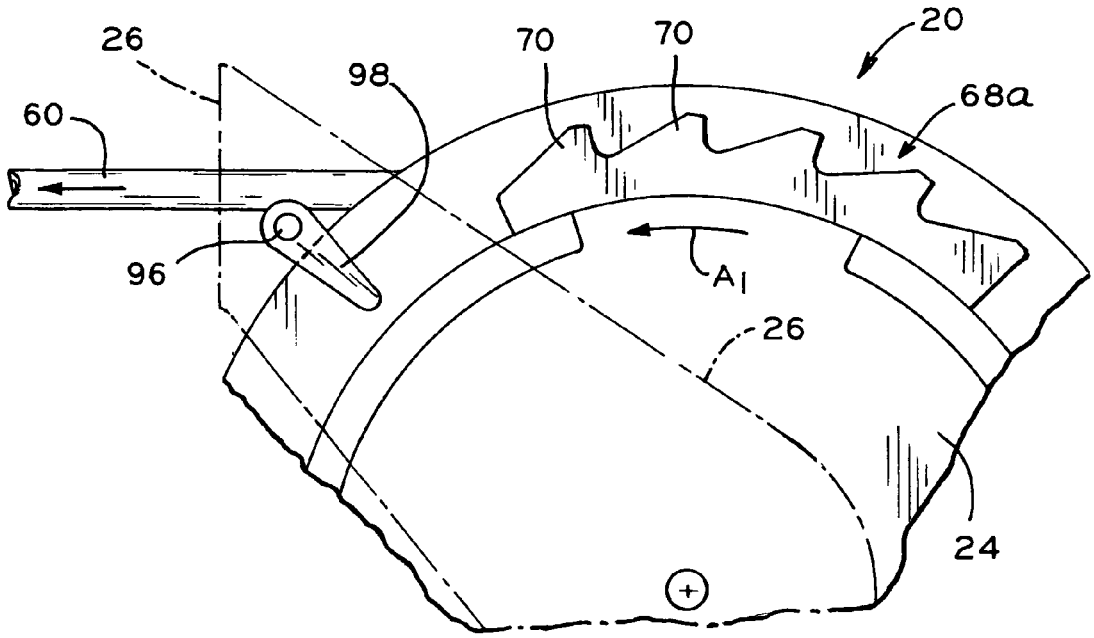
FIG. 7 is a first partial perspective view of a portion of the reel assembly with the guide arm in ghost lines, showing the ratchet teeth approaching the pawl as the hose is unwound from the spool.
Figure 11:
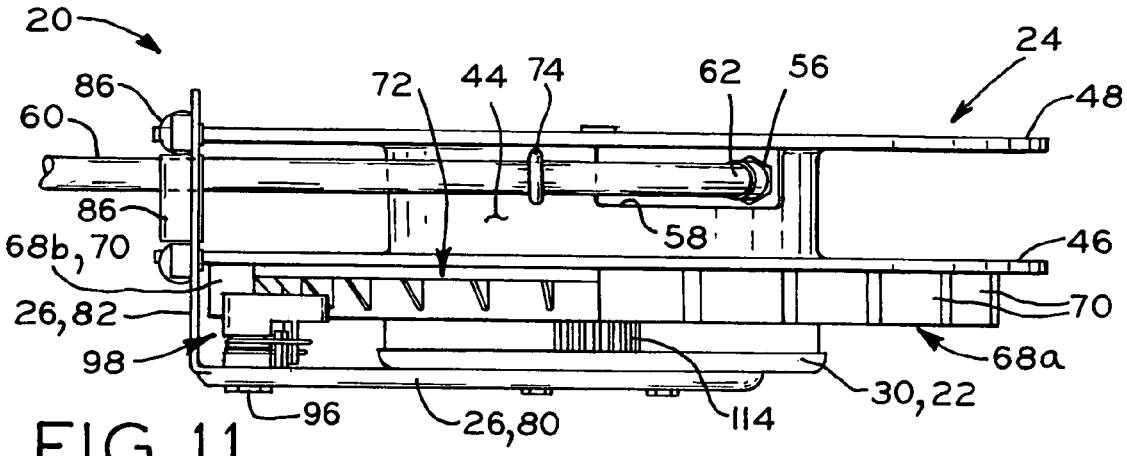
FIG. 11 is a top view of the reel assembly, showing the orientation of the guide arm, pawl, U-bolt, and ratchet teeth in relation to one another when the hose is in its fully extended position.
Figure 12:
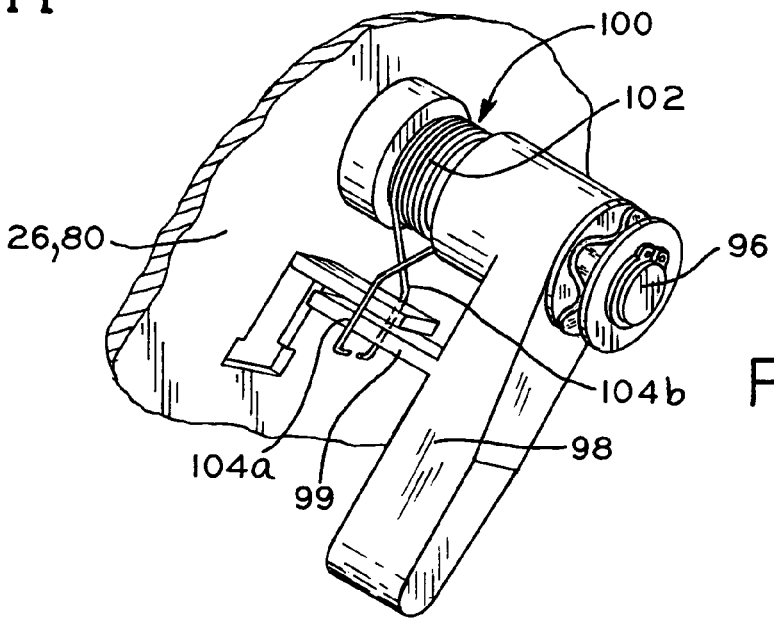
FIG. 12 is a fragmentary perspective view of the pawl and pawl spring.

Referring to FIGS. 3, 11 and 12, guide arm 26 additionally includes stud 96 with pawl 98 rotatably mounted thereon. Pawl spring 100, shown as a torsion spring, is disposed about axle 32, and includes coil portion 102 with first and second legs 104*a* and 104*b* extending therefrom. Alternatively, pawl spring 100 may be a coil spring, or any other type of spring or springs which may operatively act upon pawl 98 in the manner described below. First and second legs 104*a* and 104*b* are disposed proximate to, or are in abutment with, respective opposite sides of leg 99 of pawl 98, such that pawl 98 is normally biased thereby into a neutral position as shown in FIGS. 7 and 12. Pawl 98 is movable from its neutral position in a first rotational direction against the bias of first leg 104*a* of pawl spring 100, and is also movable from its neutral position in an opposite second rotational direction against the bias of second leg 104*b* of pawl spring 100.

Figure 13:
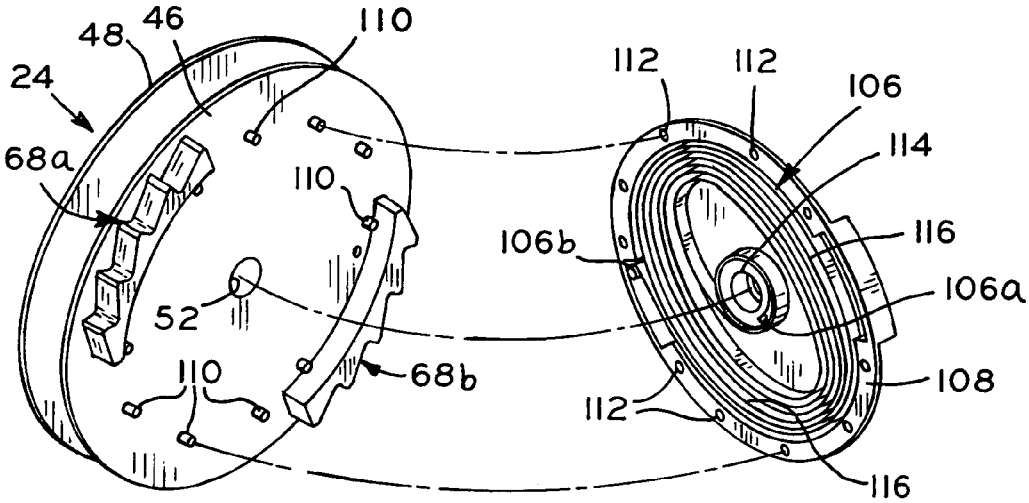
FIG. 13 is an exploded view of the spool and cover, showing the spring therein.

Referring to FIG. 13, drive spring 106, shown as a coil spring, is carried within a substantially enclosed spring housing which is defined between first side 46 of spool 24 and cover 108. Alternatively, drive spring 106 may be a torsion spring, for example. First side 46 of spool 24 includes a plurality of stakes 110 extending therefrom which are disposed about the outer periphery of spool 24. Cover 108 includes a plurality of apertures 112 around an outer periphery thereof through which stakes 110 are inserted. Thereafter, the ends of stakes 110 are deformed about apertures 112, such as with heat or by crimping with a suitable tool, for example, to thereby permanently attach cover 108 to spool 24. Alternatively, spool 24 may includes apertures 112 and cover 108 may include stakes 110. In this manner, cover 108 cannot be removed from spool 24, even with the aid of tools, without causing permanent damage to one or more of spool 24 and cover 108. Cover 108 and spool 24 thus together comprise a single, integral unit defining a spring housing therein in which drive spring 106 is contained. If drive spring 106 should fail, spool 24 and cover 108 may be detached from base 22 of hose reel 20 in the manner described above and replaced as a unit.

Spring arbor 114 is disposed within the spring housing defined between spool 24 and cover 108. When spool 24 is mounted on axle 32 of base 22 in the manner described above, spring arbor 114 engages hex portion 40 of axle to rotatably fix spring arbor 114 with respect to axle 32 and base 22. Drive spring 106 includes first end 106*a* attached to spring arbor 114 and second end 106*b* attached to an outer peripheral portion of cover 108, and further includes a large plurality of coils or turns 116 such that drive spring 106 is normally under tension to thereby bias spool 24 in a first rotational direction in which hose 60 is wound upon spool. Rotation of spool 24 in a second rotational direction opposite the first rotational direction, in which hose 60 is unwound from spool 24, as explained below, contracts the coils 116 of drive spring 106 and places same under further tension.

In FIGS. 1 and 2, hose reel 20 is disposed such that hose 60 is in a fully retracted position, with the majority of hose 60 wound about spool 24, and hose bumper 88 in abutment with guide section 82 of guide arm 26. In this position, drive spring 106 biases spool 24 in a rotational direction in which hose 60 tends to wind about spool 24, such that in the position of FIGS. 1 and 2, hose bumper 88 abuts guide section 82 of guide arm 26 under the tension of drive spring 106.

Referring to FIG. 7, as hose 60 is pulled outwardly from spool 24 by a user, spool 24 rotates in the direction of arrow $A_1$ against the rotational bias of drive spring 106. Pawl 98 is initially biased by pawl spring 100 to the neutral position shown in FIG. 7 as first set 68*a* of ratchet teeth 70 of spool 24 approaches pawl 98.

Figure 8:
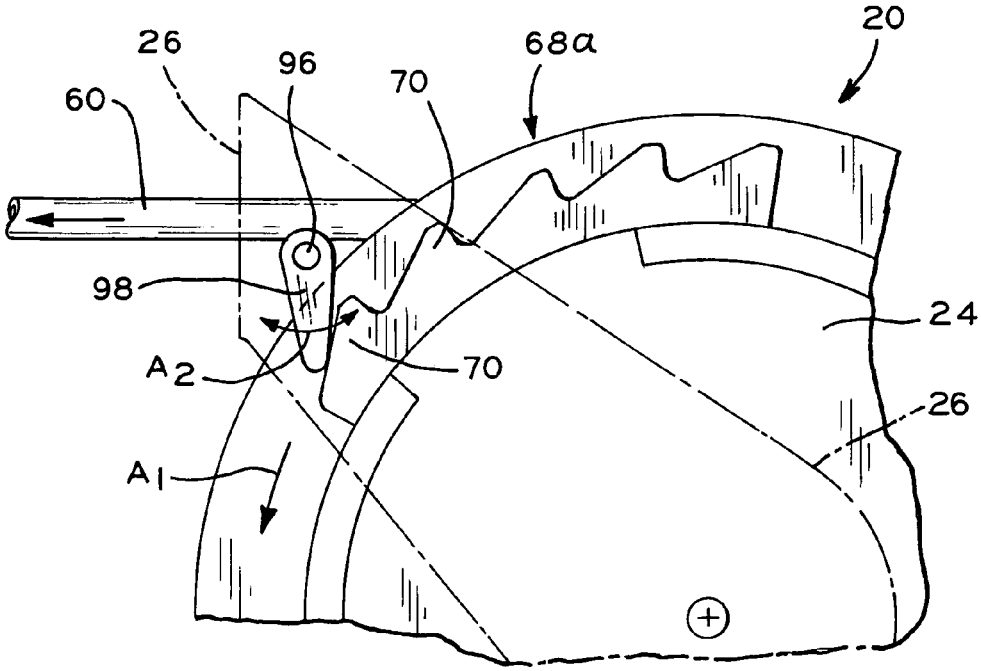
FIG. 8 is a second partial perspective view of a portion of the reel assembly with the guide arm in ghost lines, showing the pawl riding over the ratchet teeth upon continued unwinding of the hose from the spool.

Referring to FIG. 8, upon continued extension of hose 60 from spool 24, spool 24 continues to rotates in the direction of arrow $A_1$ against the rotational bias of drive spring 106, and first and second sets 68*a* and 68*b* of ratchet teeth 70 contact pawl 98. As indicated by Arrow $A_2$ in FIG. 8, pawl 89 is biased in a first direction against the bias of first leg 104*a* of pawl spring 100 as pawl 98 rides over a ratchet tooth 70. Upon clearing the ratchet tooth, pawl 98 is returned to its neutral position by first leg 104*a* of pawl spring 100. The foregoing motion of pawl 98 continues as pawl 98 successively rides over ratchet teeth 70 as hose 60 is extended from spool 24.

Figure 9:
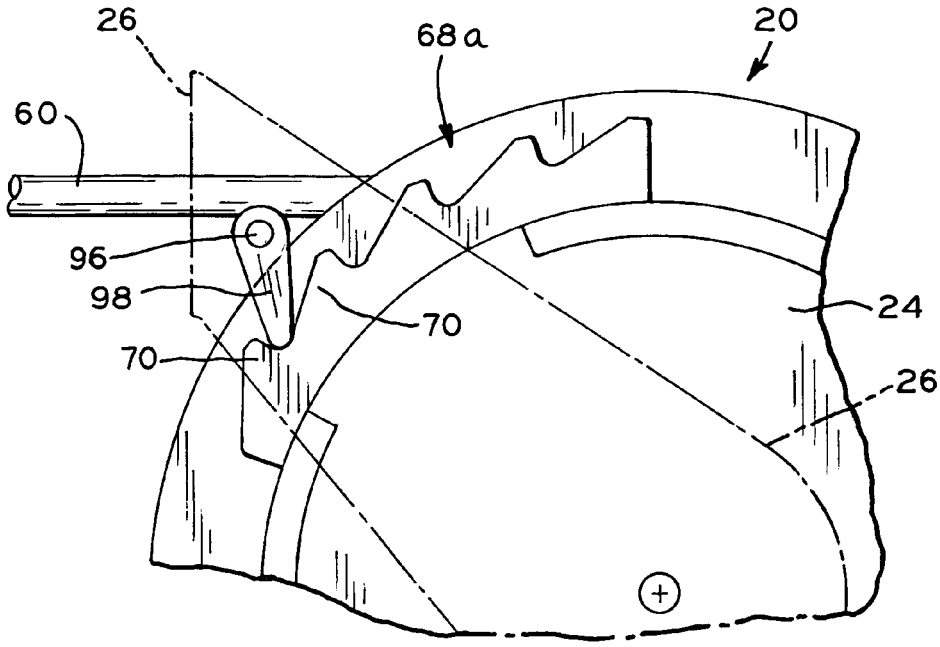
FIG. 9 is a third partial perspective view of a portion of the reel assembly with the guide arm in ghost lines, showing the pawl in engagement with the ratchet teeth to prevent rotation of the spool in its winding direction and to retain the hose in an extended position.

Referring to FIG. 9, when hose 60 is extended to a desired extent, stopping the extension of hose 60 while pawl 98 is disposed in between adjacent ratchet teeth 70, and releasing the pulling force on hose 60 causes pawl 98 to engage behind a ratchet tooth 70, with the rotational force of drive spring 106 on spool 24 holding pawl 98 in the foregoing locked position. In this position, spool 24 is under rotational tension by drive spring 106, yet is prohibited from rotating in a direction in which hose 60 is retracted, due to the locking engagement of pawl 98 with a ratchet tooth 70. Thus, hose 60 is maintained in a fixed extended position for use.

Figure 10:
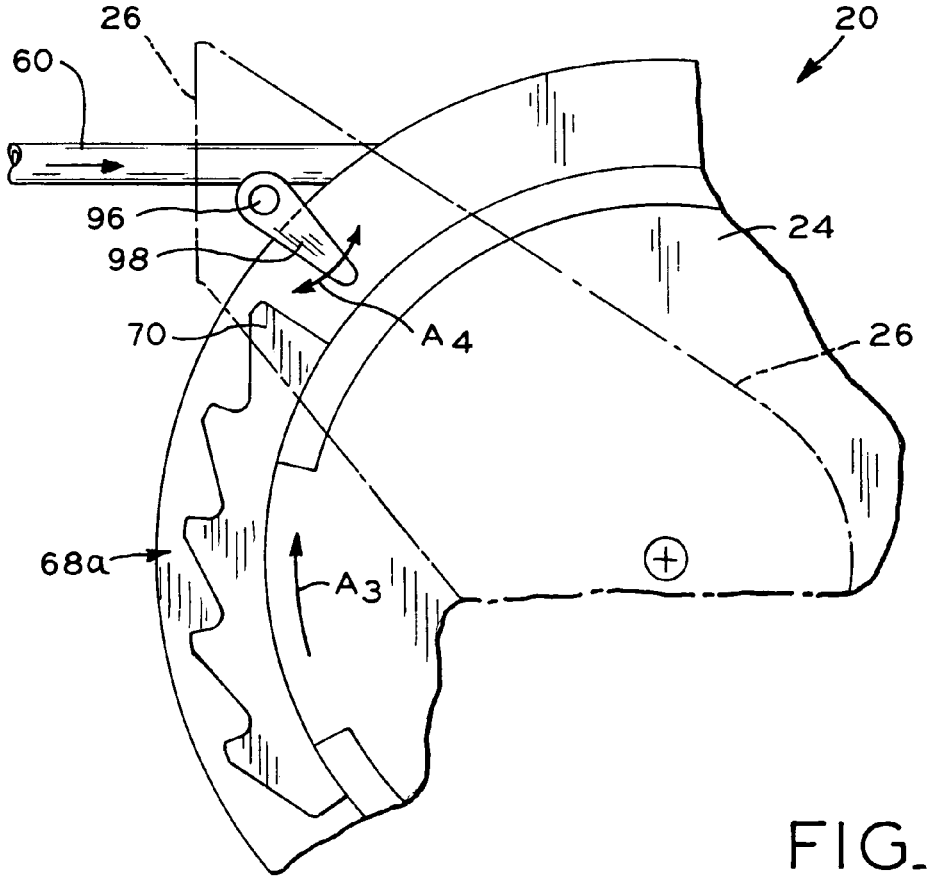
FIG. 10 is a fourth partial perspective view of a portion of the reel assembly with the guide arm in ghost lines, showing release of the pawl from the ratchet teeth as the hose is extended beyond its retained position of FIG. 9.

Referring to FIG. 10, to release pawl 98 from ratchet teeth 70, hose 60 is extended a further extent from the position of FIG. 9 to continue rotation of spool 24 against the bias of drive spring 106. Pawl 98 rides over ratchet teeth 70 as discussed above, eventually clearing the last ratchet tooth 70 in a set of ratchet teeth 68*a* or 68*b*, such that pawl 98 is biased by pawl spring 100 back to its neutral position. Thereafter, release of tension upon hose 60 allows drive spring 106 to rotate spool 24 in the retracting direction of arrow $A_3$ in FIG. 10. As spool 24 rotates and hose 60 is wound upon spool 24, pawl 98 rides over ratchet teeth 70 as shown by arrow $A_4$ in FIG. 10 in the opposite manner as that described above with respect to FIG. 8.

Referring to FIG. 11, hose 60 is shown in a fully extended position. In this position, hose 60 extends essentially tangentially from spool 24, with U-bolt 74 capturing a portion of hose 60 against central hub 44 of spool 24 to thereby relieve strain from being directly imposed upon the connection between first end 62 of hose 60 and fluid joint 56 should pulling tension be applied to hose 60 after hose 60 is fully extended. Notably, in the fully extend position shown in FIG. 11, due to the location of set 68*a* of ratchet teeth 70 proximate U-bolt 74, pawl 98 will always be disposed in one of the annular gaps 72 between sets 68*a* and 68*b* of ratchet teeth 70, regardless of the adjusted position of guide arm 26 with respect to base 22 (FIG. 4).

In this manner, regardless of the adjusted position of guide arm 26 with respect to base 22, pawl 98 is not in engagement with ratchet teeth 70 when hose 60 is fully extended, such that drive spring 106 may rotate spool 24 in a retraction direction. Also, whenever pawl 98 is in engagement with ratchet teeth 70 to prevent rotation of spool 24 in the direction in which hose 60 is retracted, the foregoing orientation guarantees that slack remains in hose 60 to allow hose 60 to be pulled outwardly of spool 24 to an extend such that pawl 98 clears the last ratchet tooth 70 in a given set 68*a*, 68*b* thereof such that hose 60 may be retracted. Thus, the foregoing orientation between U-bolt 74, ratchet teeth 68*a*, and pawl 98 mounted to guide arm 26, prevents "latch-out" when hose 60 is in a fully extended position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reel assembly, comprising:

a base;

a spool rotatably mounted to said base, said spool including at least one set of ratchet teeth;

a guide arm including a guide section thereon, said guide arm adjustably mounted to said base and extending therefrom;

a pawl member mounted to said guide arm, said pawl member engagable with said ratchet teeth; and a hose having a first end attached to one of said spool and said base and a second end guidably supported by said guide section, said hose windable about said spool, said spool including a strain relief member positioned proximate one of said sets of ratchet teeth, said strain relief member capturing a portion of said hose against said spool.

2. The reel assembly of claim 1, further comprising a spring connected between said spool and said base, said spring rotationally biasing said spool in a first direction.

3. The reel assembly of claim 1, wherein said guide arm is selectively adjustable between a plurality of radially spaced positions with respect to said base.

4. The reel assembly of claim 1, wherein each said set of ratchet teeth is integrally formed with said spool and extends around a portion of a periphery of said spool.

5. The reel assembly of claim 4, wherein said spool includes a pair of said ratchet teeth sets, said ratchet teeth sets spaced opposite one another to define a pair of angular gaps therebetween.

6. The reel assembly of claim 1, wherein said pawl member is rotatable in first and second opposite directions from a neutral position, said reel further comprising means for resisting rotation of said pawl member from said neutral position in each of said first and second directions.

7. The reel assembly of claim 1, further comprising:

a cover integrally joined to said spool, said spool and said cover together defining a substantially enclosed spring housing therebetween; and a spring carried within said spring housing, said spring rotationally biasing said spool in a first direction.

8. The reel assembly of claim 1, further comprising:

a cover integrally joined to said spool by deformation of a plurality of plastic stakes on one of said cover and said spool around a plurality of apertures in the other of said cover and said spool, said spool and said cover together defining a substantially enclosed spring housing therebetween; and a spring carried within said spring housing.

9. The reel assembly of claim 8, wherein said spring is connected between said base and said spool, said spring rotationally biasing said spool in a first direction.

10. The reel assembly of claim 1, wherein said base includes a base plate, said base plate mountable to a support surface.

11. A reel assembly, comprising:

a base;

a spool rotatably mounted to said base, said spool including at least one set of ratchet teeth;

a guide arm adjustably mounted to said base and extending therefrom;

a pawl member directly mounted to said guide arm, said pawl member engagable with said ratchet teeth; and an elongate member having a first end and a second end, said first end connected to one of said spool and said base, said elongate member moveable between a fully retracted position wherein said elongate member is substantially wound about said spool and a fully extended position wherein said elongate member is extended from said spool and said pawl member is not in engagement with said ratchet teeth, said spool including a strain relief member positioned proximate one of said sets of ratchet teeth, said strain relief member capturing a portion of said elongate member against said spool.

12. The reel assembly of claim 11, further comprising a spring connected between said spool and said base, said spring rotationally biasing said spool in a first direction.

13. The reel assembly of claim 11, wherein said guide arm is selectively adjustable between a plurality of radially spaced positions with respect to said base.

14. The reel assembly of claim 11, wherein said spool includes a pair of said ratchet teeth sets integrally formed therewith, said ratchet teeth sets spaced opposite one another along a portion of a periphery of said spool to define a pair of angular gaps therebetween.

15. The reel assembly of claim 11, wherein said pawl member is rotatable in first and second opposite directions from a neutral position, said reel further comprising means for resisting rotation of said pawl member from said neutral position in each of said first and second directions.

16. The reel assembly of claim 11, wherein said base includes a base plate, said base plate mountable to a support surface.

17. A reel assembly, comprising:

a base;

a spool rotatably mounted to said base, said spool including at least one set of ratchet teeth;

a guide arm adjustably mounted to said base and extending therefrom;

a pawl member mounted to said guide arm, said pawl member engagable with said ratchet teeth;

an elongate member having a first end and a second end, said first end connected to one of said spool and said base, said elongate member moveable between a fully retracted position wherein said elongate member is substantially wound about said spool and a fully extended position wherein said elongate member is extended from said spool; and a strain relief member capturing a portion of said elongate member against said spool, wherein when said elongate member is in said fully extended position, said pawl member is not in engagement with any one of said ratchet teeth and said strain relief member reduces pull strain imposed on said first end of said elongate member.

18. The reel assembly of claim 17, wherein said base includes a base plate, said base plate mountable to a support surface.

19. The reel assembly of claim 17, wherein said guide arm includes a guide section thereon.

20. The reel assembly of claim 17, wherein said ratchet teeth are integrally formed with said spool.

21. A reel assembly, comprising:

a base;

a spool rotatably mounted to said base, said spool including at least two sets of ratchet teeth;

a guide arm adjustably mounted to said base and extending therefrom;

a pawl member mounted to said guide arm, said pawl member engagable with said ratchet teeth;

an elongate member having a first end and a second end, said first end connected to one of said spool and said base, said elongate member moveable between a fully retracted position wherein said elongate member is substantially wound about said spool and a fully extended position wherein said elongate member is extended from said spool; and a strain relief member attached to said spool and disposed circumferentially between two of said sets of ratchet teeth, said strain relief member securing a portion of said elongate member with respect to said spool, wherein when said elongate member is in said fully extended position, said pawl member is not in engagement with any one of said ratchet teeth and said strain relief member reduces pull strain imposed on said first end of said elongate member.

22. The reel assembly of claim 21, wherein said base includes a base plate, said base plate mountable to a support surface.

23. The reel assembly of claim 21, wherein said guide arm includes a guide section thereon.

24. The reel assembly of claim 21, wherein said ratchet teeth are integrally formed with said spool.

25. A reel assembly, comprising:

a base;

a cylindrical spool rotatably mounted to said base and defining a circumference, said spool including at least one set of ratchet teeth, each set of ratchet teeth extending around only a portion of said circumference of said spool;

a guide arm adjustably mounted to said base and extending therefrom;

a pawl member mounted to said guide arm, said pawl member engagable with said ratchet teeth;

an elongate member having a first end and a second end, said first end connected to one of said spool and said base at a connection fitting, said elongate member moveable between a fully retracted position wherein said elongate member is substantially wound about said spool and a fully extended position wherein said elongate member is extended from said spool; and said at least one set of ratchet teeth, said pawl member, and said connection fitting relatively positioned with respect to one another such that said pawl member is not in engagement with any one of said ratchet teeth when said elongate member is in said fully extended position.

26. The reel assembly of claim 25, wherein said spool includes at least two sets of ratchet teeth each extending around only a portion of said circumference of said spool with at least two respective gap spaces defined between said at least two sets of ratchet teeth.

27. The reel assembly of claim 25, wherein said base includes a base plate, said base plate mountable to a support surface.

28. The reel assembly of claim 25, wherein said at least one set of ratchet teeth is integrally formed with said spool.

29. The reel assembly of claim 25, including a strain relief member capturing a portion of said elongate member against said spool.

* * * * *